US005469896A

United States Patent [19]

Christe et al.

[11] Patent Number: 5,469,896

[45] Date of Patent: Nov. 28, 1995

[54] ROTATABLE CUTTING DEVICE FOR WEFT THREADS

[75] Inventors: Marcel Christe, Rüti; Urs Schaich, Eschenbach, both of Switzerland

[73] Assignee: Sulzer Rueti AG, Rueti, Switzerland

[21] Appl. No.: 238,297

[22] Filed: May 9, 1994

[30] Foreign Application Priority Data

May 21, 1993 [EP] European Pat. Off. ..... 93810376

[51] Int. Cl.[6] ..... D03D 49/70; D03D 47/36

[52] U.S. Cl. ..... 139/450; 139/28

[58] Field of Search ..... 139/302, 450, 139/28, 291 C; 83/500, 501, 504, 485

[56] References Cited

U.S. PATENT DOCUMENTS

| | | | |
|---|---|---|---|
| 3,036,486 | 5/1962 | Wilcox | 83/500 X |
| 4,129,153 | 12/1978 | Bonetti | 139/28 |
| 4,254,680 | 3/1981 | Gauthier | 83/504 X |
| 4,548,117 | 10/1985 | Frye | 83/500 |
| 4,643,058 | 2/1987 | Zingler et al. | 83/501 |
| 4,665,787 | 5/1987 | Arnold et al. | 83/485 |
| 4,776,249 | 10/1988 | Barclay | 83/500 X |
| 5,144,874 | 9/1992 | Garrett | 83/500 X |

FOREIGN PATENT DOCUMENTS

| | | |
|---|---|---|
| 0143119 | 6/1985 | European Pat. Off. . |
| 6433246 | 7/1987 | Japan . |

*Primary Examiner*—Andy Falik

*Attorney, Agent, or Firm*—Townsend and Townsend and Crew

[57] ABSTRACT

A cutter for use with looms has a positionally stable, rotating first cutting member (1) and a rotating second cutting member (2) which is moveable in relation to the first cutting member. The cutting members are conneeted in a frictional manner by an energy storing device (8) and rotate in opposite directions. The movable second cutting member (2) is mounted so that it can freely rotate on an axle (6), which is retained in a torsionally secure manner in membrane springs (11), which are elastically deformable in the axial direction in order to compensate for the lateral deflections of the rotating, positionally stable first cutting member (1), as a result of which the service life of the cutters is extended. The device is particularly suitable for a series shed loom because a high cutting rhythm can be achieved.

12 Claims, 3 Drawing Sheets

ROTATABLE CUTTING DEVICE FOR WEFT THREADS

BACKGROUND OF THE INVENTION

The present invention relates to a device for cutting weft threads for a loom having a freely rotatable and positionally stable cutting member and a driven, movably disposed cutting member. The cutting members rotate in opposite directions about parallel axes of rotation and there is a device such as a spring which frictionally connects the cutting members. The present invention also includes a loom fitted with such a cutting device.

JP-A 64-33246 discloses a cutting device which comprises one positionally stable and one displaceably disposed cutting member. The cutting members can rotate in opposite directions around axes of rotation disposed parallel to one another and to form a cutting point are disposed partially abutting one another. The displaceable cutting member is attached to a connecting member which is disposed in an axially displaceable manner on a drive shaft of the device. In the connecting member is disposed a helical spring which forces the displaceable cutting member against the positionally stable cutting member so that a frictional connection is created, by which the positionally stable cutting member is driven. In this cutting device the fact that the connecting member has to transmit the rotation, has to produce the frictional connection of the cutting members and at the same time has to compensate for the lateral axial deflection of the rotating, positionally stable cutting member has proved to be a disadvantage. This multiple function of the connecting member results in restrictions in the speed of the cutting member and heavy wear to the cutters caused by slip and consequently shorter service lives of the cutting members.

SUMMARY OF THE INVENTION

An object of the invention is to create a cutting device in which the disadvantages mentioned are removed by separating the functions of driving the cutting members and the frictional connection of the cutting members. Furthermore the present achievement of the rotational movement has the advantage that a faultless operation is guaranteed with a high cutting rhythm.

The advantages which can be achieved with the invention are essentially regarded as being that because of the low-mass design and the freely rotating arrangement of the mobile cutting member a faultless frictional connection is guaranteed and axial impacts occurring in the axial direction are compensated without friction by the retention parts.

DESCRIPTION OF THE PREFERRED EMBODIMENTS

Figure 4:
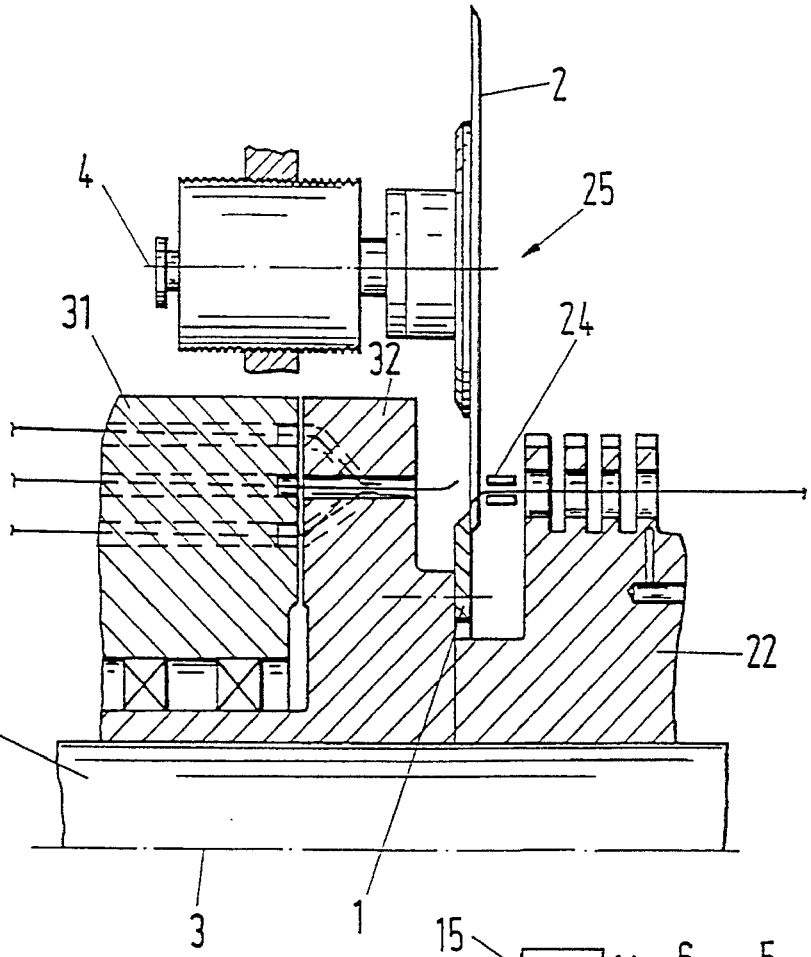
FIG. 4 shows a section taken along line IV—IV in FIG. 3.
Figure 1:
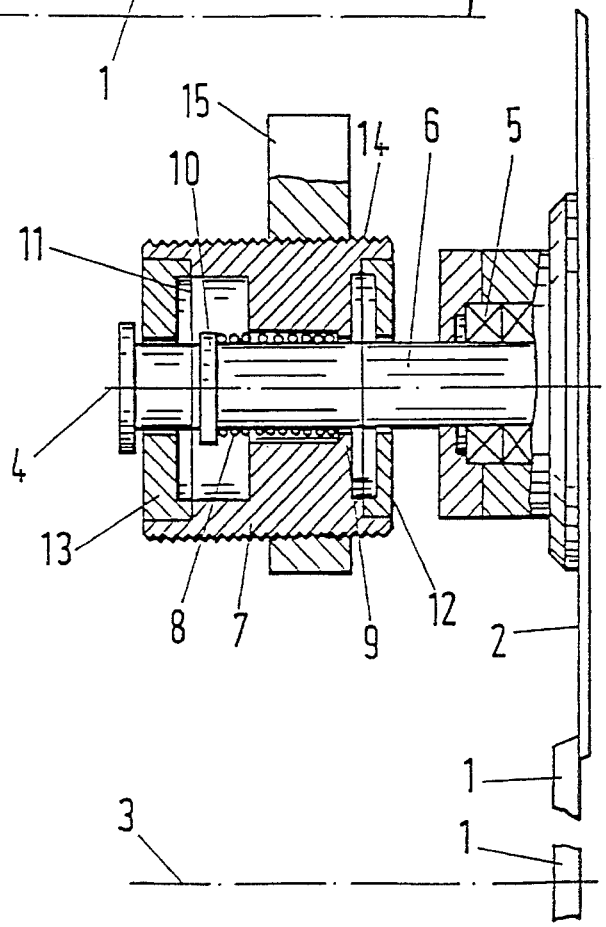
FIG. 1 diagrammatically shows a partially sectional view of an embodiment of a cutting device according to the invention.

The weft thread cutting device has two cutting members 1, 2, which can rotate around two parallel axes of rotation 3, 4, whereby one cutting member is disposed so that it is positionally stable and hereinafter is designated as main cutter 1, and the other cutting member 2 is disposed so that it is mobile and hereinafter is referred to as exterior cutter 2. The main cutter 1 and the exterior cutter 2 are disposed so that they overlap slightly to form a cutting point. The main cutter 1 is attached to a rotating part (not represented), which drives the main cutter. The exterior cutter 2 is rotatably disposed around the axis of rotation 4 and is forced against the main cutter 1 so that the exterior cutter 2 rotates in the opposite direction. The exterior cutter 2 is set for example by 1.5° to the main cutter in order to achieve a point contact between the cutters.

For this purpose the exterior cutter 2 is mounted by means of rolling bearing 5 on an axle 6, which is disposed in an axially displaceable but torsionally secure manner in a housing 7. On the axle 6 is disposed a helical spring 8, which firstly abuts a shoulder 9 in the housing 7 and secondly abuts a bead 10 on the axle 6. This helical spring 8 is a pressure spring, which pulls the exterior cutter 2 towards the main cutter 1 so that a frictional connection is produced between the main and exterior cutters 1, 2. By this frictional connection the exterior cutter 2 is driven by the main cutter 1. The axle 6 is mounted in two flat membrane springs 11, which are disposed spaced apart in the housing 7 and are attached by two covers 12, 13 in the housing 7 so that the membrane springs 11 are disposed at right angles to the axis of rotation 4 of the axle 6. The housing 7 has a cylindrical construction and comprises an external thread 14. The housing 7 can be screwed into a support 15, in order to adjust the exterior cutter 2 in relation to the main cutter 1.

Figure 2:
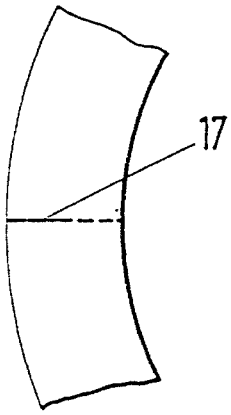
FIG. 2 shows a portion of a cutting member, FIG. 3 diagrammatically shows a plan view of the rotor of a series shed loom having a cutting device as shown in FIG. 1.

The main cutter 1 has an annular construction and comprises two separating points 17 produced by fracture in order to separate the main cutter 1 for assembly into two parts (FIG. 2). These separating points are chosen so that they come to lie between the thread cutting points during the rotational movement.

Figure 3:
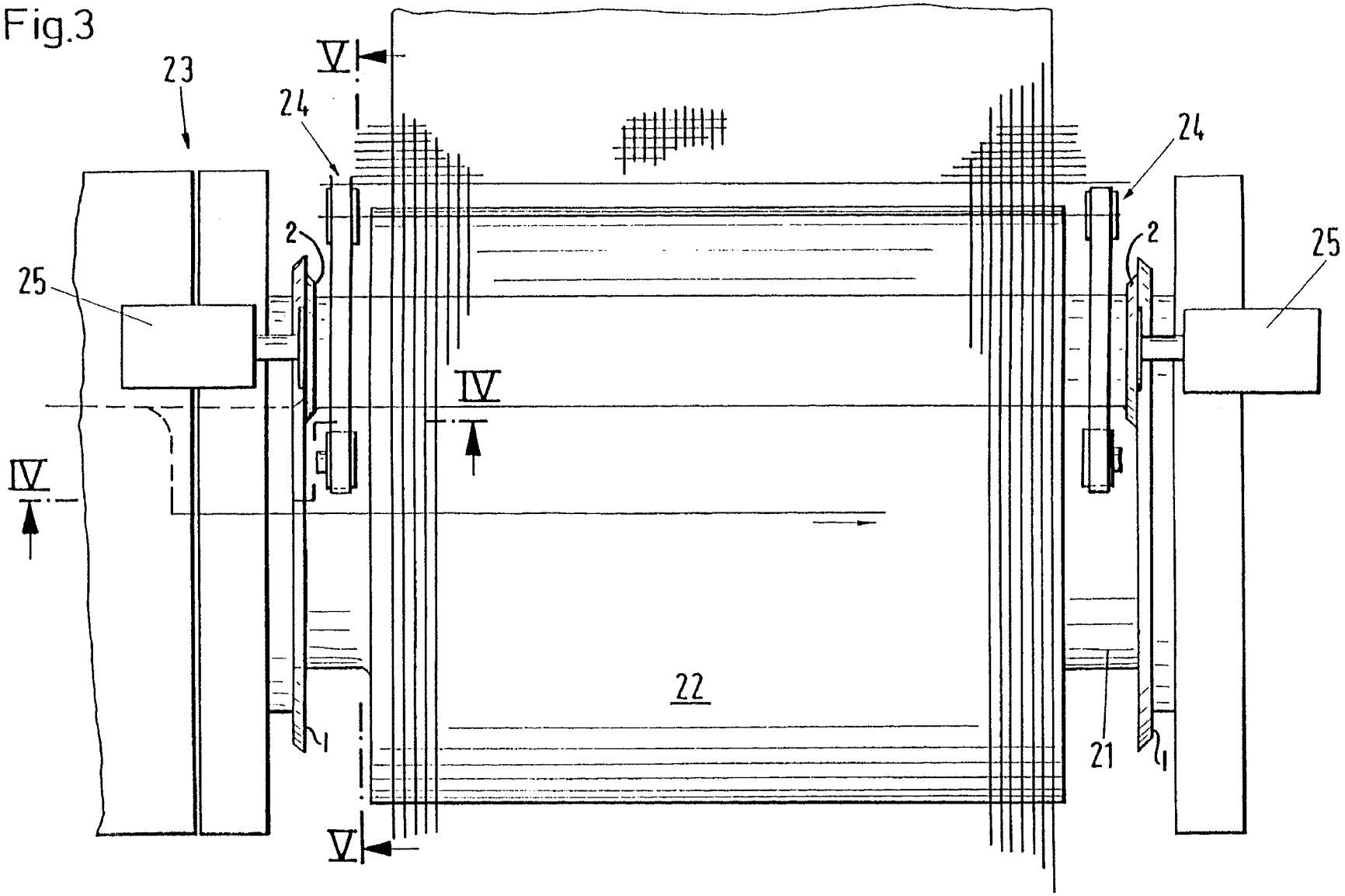

The series shed loom shown in FIG. 3 comprises a rotor shaft 21, which is connected to a driving device (not represented), a rotor 22, which is disposed on the rotor shaft, a weft thread distribution device 23, which is disposed at a distance from the rotor on the insertion side of the loom, and two weft thread retention devices 24, which are disposed on both sides of the rotor 22. As FIG. 3 shows, seen in the thread direction one weft thread cutting device 25 described above is disposed on the insertion side of the loom in front of the weft thread retention device and another is disposed on the catch side of the loom behind the thread retention device.

FIG. 4 shows the arrangement of the cutting device 25 in relation to the distribution device 23, which comprises a fixed part 31 and a part 32 rotating with the rotor 22. The main cutter 1 is attached to the part 32 and rotates synchronously with the rotor. The exterior cutter 2 overlaps the main cutter 1 to form the cutting point. The arrangement is designed so that the exterior cutter 2 lies at a suitable distance from the retention device to assure the cutting of the weft thread.

Figure 5:
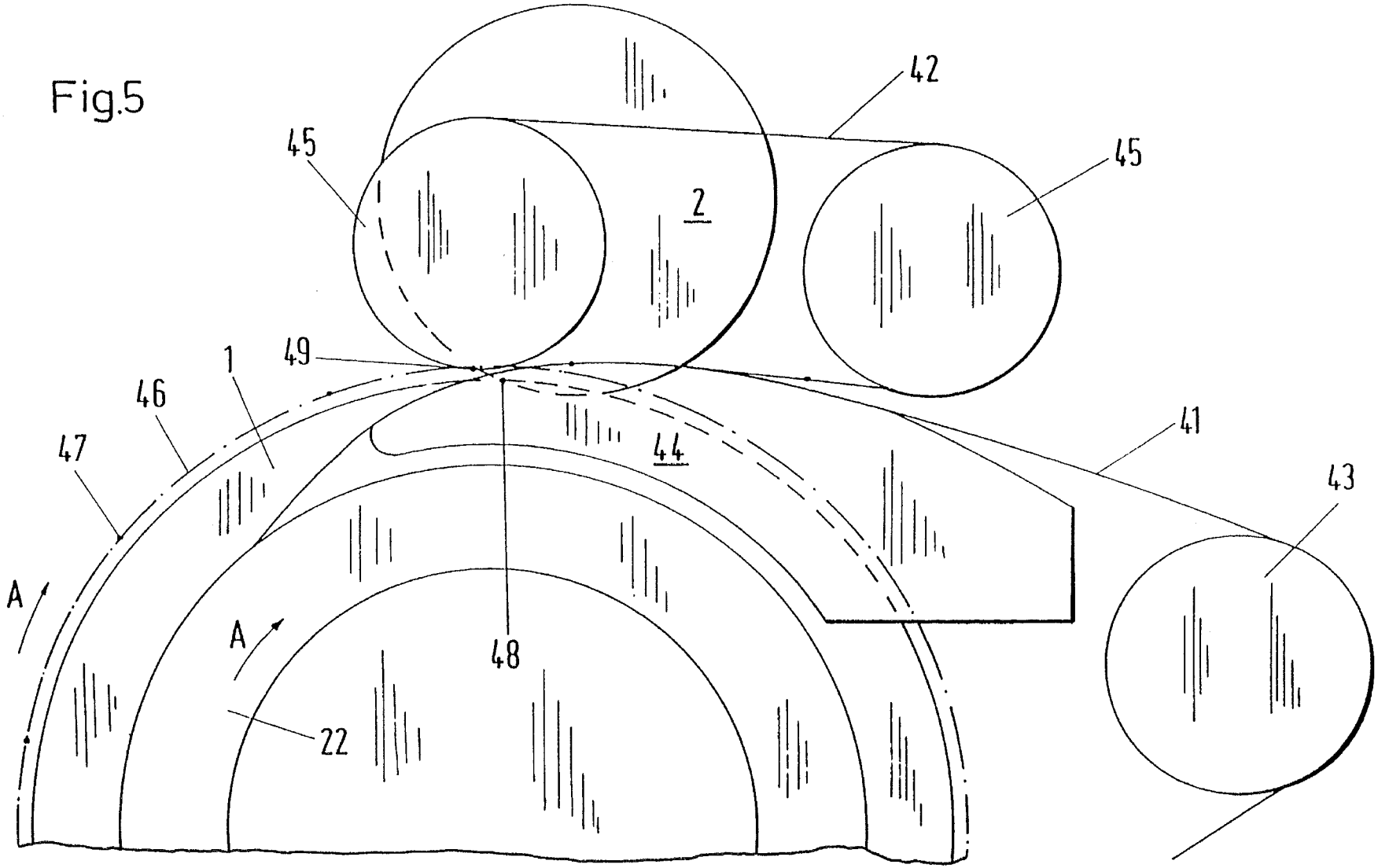
FIG. 5 shows a section taken along line V—V in FIG. 3.

The association of the cutting device and the retention device which can be seen from the diagrammatical representation shown in FIG. 5 is essential for a faultless cutting of the weft thread.

The retention device contains two endless conveyor belts 41, 42. One conveyor belt 41 is laid around a guide roller 43 and around the rotor 22, which drives the conveyor belt 41, hereinafter referred to as the driving belt. Conveyor belt 41 is also guided via a guide part 44, which is provided with a mechanism (not represented) in order to effect air lubrication between the bearing surface on the guide part 44 and the surface of the conveyor belt. The other conveyor belt 42 is guided around two guide rollers 45 so that a surface portion of the conveyor belt 42 lies on the surface of the driving belt 41. As a result this conveyor belt 42 is driven by the driving belt 41 and hereinafter is referred to as the driven belt 42. In FIG. 5 the main cutter 1 and the exterior cutter 2 and also the track 46 of the weft insertion nozzles 47, which rotate synchronously with the rotor 22 (arrow A), are also represented. As already mentioned, the main cutter 1 and the exterior cutter 2 are disposed so that they overlap, as a result of which the cutting point is formed. As the representation shows, the driving and the driven belts 41, 42 form a feed nip, into which the weft thread is clamped after the end of the filling operation. A clamping point 49 is formed, which by the association of the cutting and the retention devices in the direction of movement of the weft thread lies in front of the cutting point 48. Thus it is guaranteed that the weft thread is retained in the retention device before cutting and then is conveyed past the cutting point until it reaches a stop point.

The device has a positionally stable rotating cutting member (1) and a rotating cutting member (2) which moves in relation thereto, which are connected in a frictional manner by an energy storing device (8) and rotate in opposite directions. The movable cutting member (2) is mounted so that it can freely rotate on an axle (6), which is retained in a torsionally secure manner in membrane springs (11), which are elastically deformable in the axial direction in order to compensate for the lateral deflections of the rotating, positionally stable cutting member (1), as a result of which the service life of the cutters is increased. The device is particularly suitable for a series shed loom because a high cutting rhythm can be achieved.

What is claimed is:

1. A device for cutting weft threads for a loom having a driven member which rotates about a first axis comprising a positionally stable first cutting member adapted to be secured to the driven member of the loom for rotation therewith; a second cutting member; a shaft on which the second cutting member is rotatably mounted, the shaft having a second axis which is parallel to the first axis; a support for nonrotatably mounting the shaft, permitting relative movements of the shaft in an axial direction and positioning the second cutting member so that a portion thereof overlaps a portion of the first cutting member; and a spring biasing the shaft and therewith the second cutting member in an axial direction into engagement with the first cutting member so that rotation of the first cutting member in a first direction frictionally imparts rotation to the second cutting member in a second, opposite direction.

2. A device according to claim 1, wherein the support is made from spring steel.

3. A device according to claim 2, wherein the support comprises a membrane spring.

4. A device according to claim 3, wherein the support comprises a plane spring.

5. A device according to claim 1, wherein the spring exerts a force which biases the shaft and the second cutting member in the axial direction, and including means for adjusting a magnitude of the force.

6. A device according to claim 1 wherein the first cutting member comprises an annular disc having first and second disc sectors.

7. A device according to claim 6, wherein the sectors of the first cutting member are separated by disc fractures which are diametrally opposite from each other.

8. A device according to claim 6 wherein the first and second disc sectors comprise substantially semicircular annular disc sectors.

9. A device for cutting weft threads for a loom provided with a driven member which rotates about a first axis, the device comprising a first disc-shaped cutting member adapted to be secured to the driven member for rotation therewith and having a face; a second disc-shaped cutting member having a face adapted to cooperate with the face of the first cutting member; a support for the second cutting member including first and second, spaced-apart resilient plate members, a shaft nonrotatably secured to the plate members and oriented parallel to the first axis, the plate members permitting relative movement of the shaft in an axial direction of the shaft, and a bearing rotatably mounting the second cutting member to the shaft in an axially fixed position thereon so that the second cutting member moves in the axial direction with the shaft, the support being adapted to position the second disc relative to the first disc so that portions of the discs overlap and the respective faces are in relatively close proximity; and a spring operatively coupled with the shaft and the support for biasing the face of the second cutting member into engagement with the face of the first cutting member for generating friction between the faces so that rotation of the first cutting member by the driven member frictionally imparts a corresponding rotation to the second cutting member.

10. A loom for weaving a fabric comprising a driven member which rotates about an axis; a first cutting member secured to the driven member for rotation therewith and having an axially oriented face; a second cutting member including a face; a shaft rotatably coupled to the second cutting member and oriented substantially parallel to the axis; a support attached to the loom nonrotatably mounting the shaft so that the face of the second cutting member is opposite to and partially overlaps the face of the first cutting member; means permitting axial movements of the shaft relative to the support; and a spring operatively coupled to the support and the shaft biasing the shaft and therewith the second cutting member towards the first cutting member to establish contact between the faces of the cutting members so that rotation of the driven member and therewith of the first cutting member frictionally rotates the second cutting member.

11. A loom according to claim 10 wherein the loom is a series shed loom.

12. A loom according to claim 11 wherein the loom further comprises a rotor, a weft thread distribution device which is spaced from the rotor, and a weft retention device which is disposed adjacent an entrance to a shed of the rotor, wherein the cutting device is disposed between the distribution device and the weft retention device, and wherein the first cutting member is disposed coaxially relative to the rotor.

* * * * *